US005352128A

United States Patent [19]

Bricaud

[11] Patent Number: 5,352,128

[45] Date of Patent: Oct. 4, 1994

[54] CONNECTION ASSEMBLY WITH FAST BREAK SWITCHES

[75] Inventor: Herve Bricaud, Dole, France

[73] Assignee: ITT Industries, Inc., Secaucus, N.J.

[21] Appl. No.: 968,656

[22] Filed: Oct. 28, 1992

[30] Foreign Application Priority Data

Oct. 31, 1991 [FR] France ..... 91 13502

[51] Int. Cl.[5] ..... H01R 13/703

[52] U.S. Cl. ..... 439/188; 200/51.1

[58] Field of Search ..... 439/188; 200/51.09, 200/51.1

[56] References Cited

U.S. PATENT DOCUMENTS

| | | | |
|---|---|---|---|
| 1,160,619 | 11/1915 | Klein | 200/51.09 |
| 1,470,824 | 10/1923 | Freeman | 200/51.09 |
| 1,731,893 | 10/1929 | Fischer | 200/51.09 |
| 2,827,523 | 3/1958 | Heuberger et al. | 200/51.09 |
| 3,843,854 | 10/1974 | Mori et al. | 200/51.09 |
| 3,914,564 | 10/1975 | Reed et al. | 200/51.1 |
| 4,264,115 | 4/1981 | Chow | 339/45 |
| 4,911,650 | 3/1990 | Ramos | 439/188 |
| 4,934,954 | 6/1990 | Fransson et al. | 439/131 |

FOREIGN PATENT DOCUMENTS

| | | |
|---|---|---|
| 0232981 | 1/1987 | European Pat. Off. . |
| 2418634 | 4/1974 | Fed. Rep. of Germany . |
| 2468197 | 10/1980 | France . |

*Primary Examiner*—Neil Abrams

*Attorney, Agent, or Firm*—Thomas L. Peterson

[57] ABSTRACT

An electrical connector assembly includes two connectors (22, 24), wherein the first connector has a pair of contacts (46A, 46B, FIG. 9 ) which rapidly break engagement as the connectors slowly approach each other. An actuator (60), has a ridge deflector (72) for moving back a contact end portion (52A), the actuator being urged rearwardly (R) by a first spring (100). However, a pair of rearwardly bowed trigger springs (82) press against surfaces (96) to resist rearward (R) actuator movement. As the connectors progressively approach each other, the first spring (100) is progressively compressed, causing increasing deflection of the middles of the trigger springs (82), until resistance offered by the trigger springs suddenly decreases. The actuator then moves rapidly rearward, so its deflector (72) moves back the contact end portion (52A) to rapidly open the switch. The actuator is rapidly moved back by the now-compressed first spring (100).

18 Claims, 7 Drawing Sheets

CONNECTION ASSEMBLY WITH FAST BREAK SWITCHES

BACKGROUND OF THE INVENTION

The present invention relates to a connection assembly of the type comprising two complementary connectors, such as a plug and a socket of the circuit-looping type. This type of connector, also called "self-looping", is used to connect an apparatus in series with a circuit, with the complete breaking of the connection occurring during a brief period such as, for example, on the order of a few hundreds of microseconds. Rapid breaking avoids a moderately high resistance for a considerable period, which could cause arcing, erratic circuit operation, or other problems. The connector may have two switches which must be opened (and later closed) simultaneously, to assure that both switches are always in the same open or closed states.

In prior systems, the triggering speed of the switches depends directly on the relative speed at which the two connector housings approach each other. If mating occurs while a threaded coupling ring on one connector is turned about threads on the other connector, then switch operation may be slow, and two switches may be operated at distinctly different times.

SUMMARY OF THE INVENTION

In accordance with one embodiment of the present invention, a first connector of a pair of mating connectors, includes a fast break switch. The switch includes a pair of switch contacts, with at least one being a blade or leaf with a deflectable outer end. The first connector includes a rearwardly biased actuator with a deflector that can deflect the outer end of the leaf away from the other switch contact, when the actuator rapidly slides rearward. Initially, there is resistance to rapid rearward movement of the actuator, by a bowed trigger spring. The bowed spring has opposite ends mounted on the actuator, and a middle that is rearwardly bowed and that abuts a trigger surface. As the connectors continue to approach each other, the middle of the spring becomes sufficiently forwardly deflected, that it suddenly loses most resistance to further forward deflection, thereby allowing the actuator to rapidly move to the rear and rapidly fully open the switch. When two switches are opened by the rearwardly moving actuator, the rapid rearward actuator movement assures that both switches will open at substantially the same time.

The actuator is biased to the rear by an actuator biasing spring, such as a coil spring that is compressed. The biasing spring can rapidly move the actuator to the rear. The biasing spring is progressively compressed as the connectors approach each other, so large compression of the biasing spring occurs only during mating of the connectors.

DESCRIPTION OF THE PREFERRED EMBODIMENTS

1. Summary Description of One Embodiment

Figure 1:
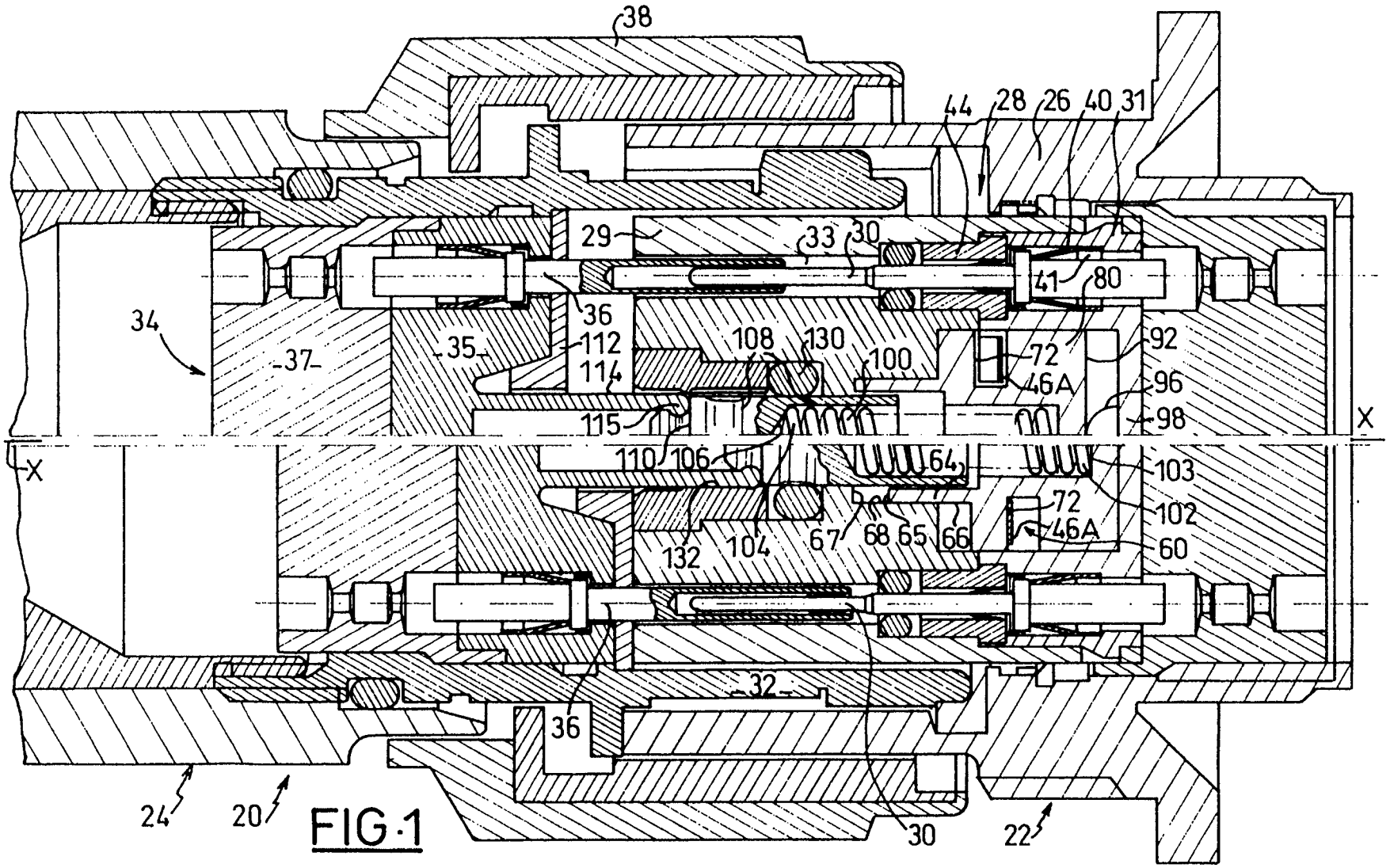
FIG. 1 is an axial cross-sectional view of a connection assembly in accordance with a first embodiment of the invention, in which the upper half-view shows the actuator in its rest or forward position, and the lower half-view shows the actuator in its active or rearward position.

FIG. 1 illustrates a connection assembly 20 that includes a first connector or socket 22 and a second connector or plug 24. The upper half of FIG. 1 shows the connectors prior to full mating, while the lower half shows them fully mated. The two connectors 22 and 24 are of a generally cylindrical shape and have a common axis X—X. As the connectors mate, pin contact elements 30 of the first connector are received in socket contact elements 36 of the second connector.

In the course of mating, a fast break switch is opened, as a pusher 114 on the second connector pushes against the front face 110 of a hollow piston 108, to compress an actuator biasing spring 100, the two of them forming an actuator biasing device. Spring 100 pushes an actuator 60 rearwardly, with a progressively greater force, until a mechanism, described below, suddenly releases the actuator. The actuator then "shoots" rearwardly under the force of the compressed biasing spring 100, to rapidly open a switch, as described below.

Figure 9:
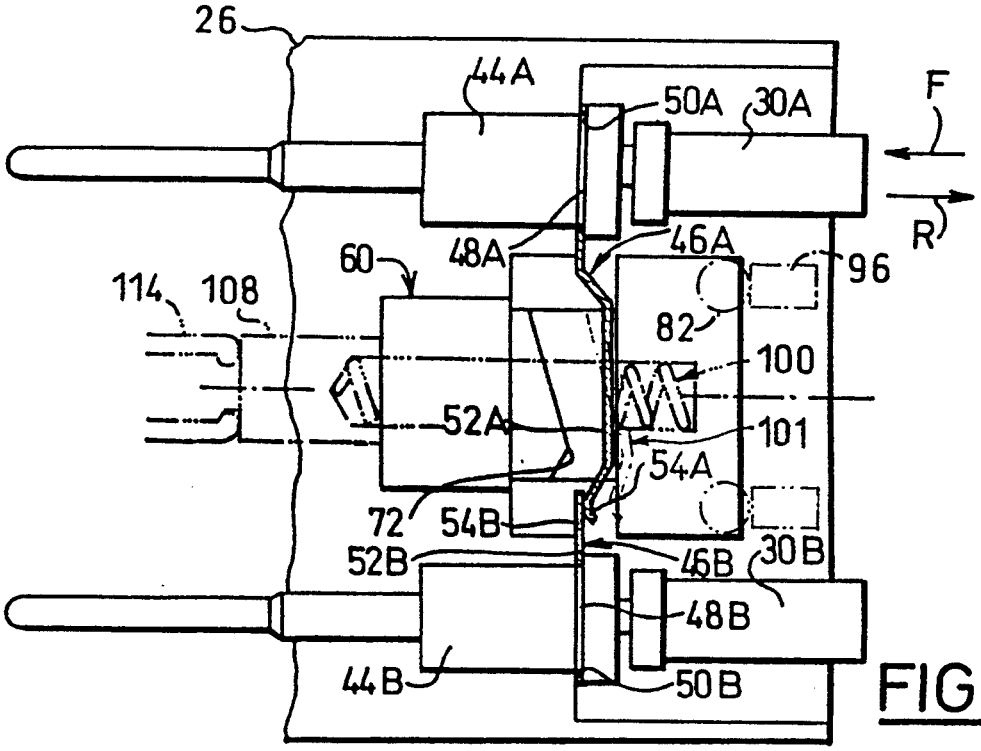
FIG. 9 is a diagram illustrating the interaction of the actuator with the electrical contact blades which constitute a switch.
Figure 10:
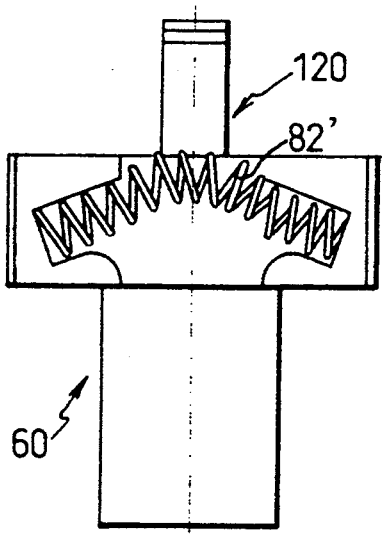
FIG. 10 is a view similar to FIG. 2, but illustrating another embodiment of the actuator.
Figure 14:
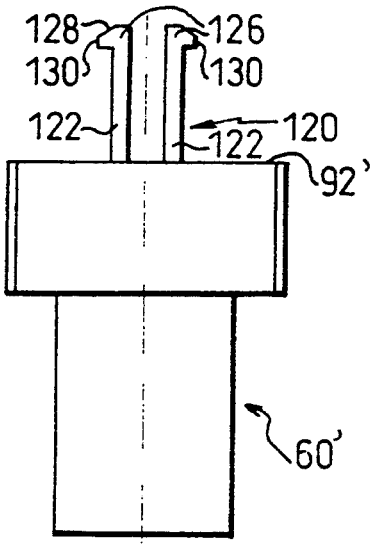
FIG. 14 is a left-hand side view of the actuator of FIG. 10.
Figure 11:
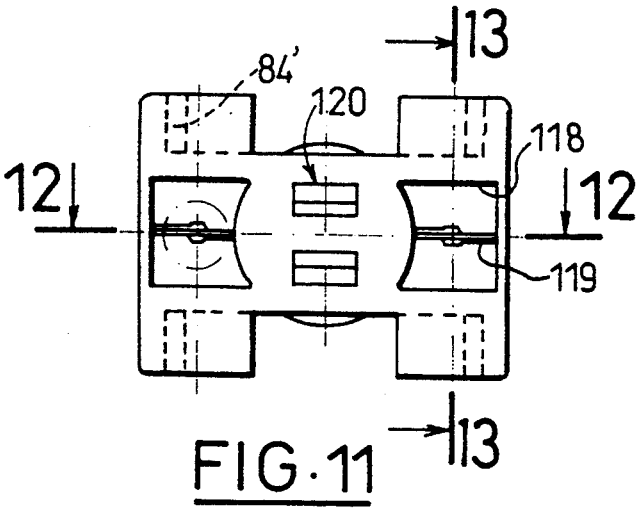
FIG. 11 is a top view of the actuator of FIG. 10.
Figure 13:
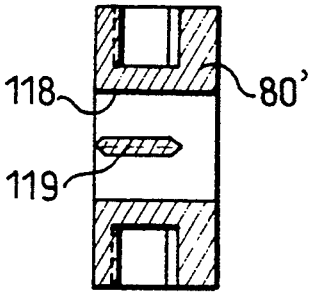
FIGS. 12 and 13 are cross-sectional views along lines 12—12 and 13—13 of FIG. 11.
Figure 12:
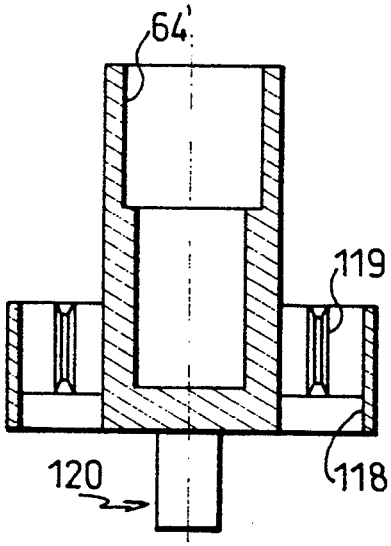
Figure 17:
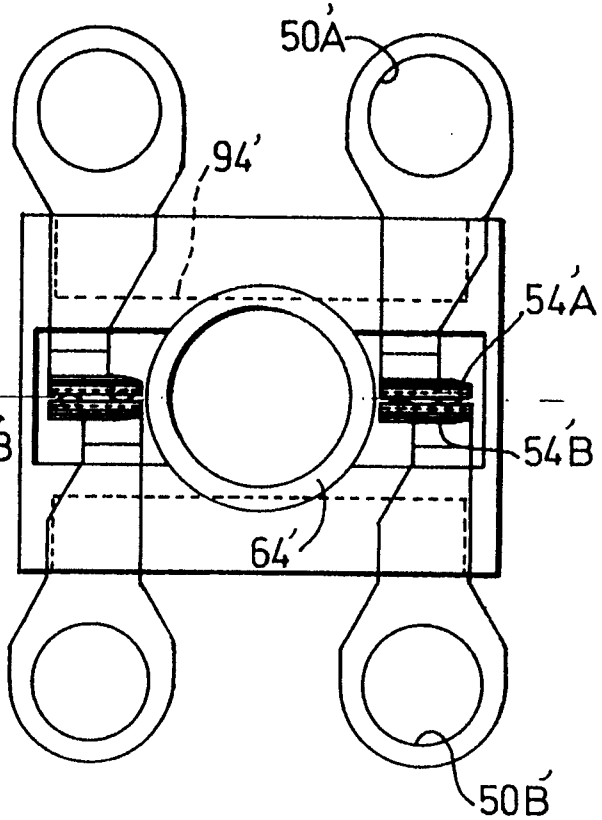
FIG. 17 is a right-hand side view of the assembly illustrated in FIG. 15 in which the actuator and the electrical contact blades may be seen.
Figure 16:
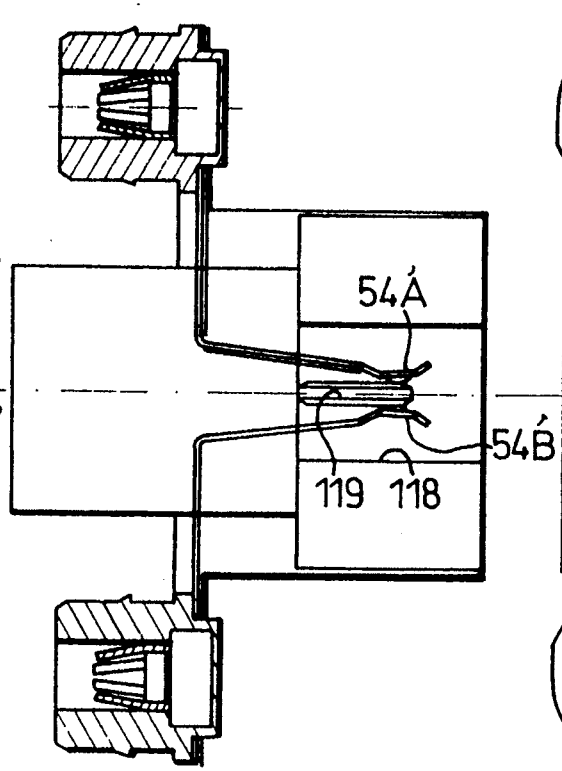
FIGS. 15 and 16 are views illustrating the interaction of the actuator illustrated in FIGS. 10 to 14 with a second embodiment of the electrical contact blades.
Figure 15:
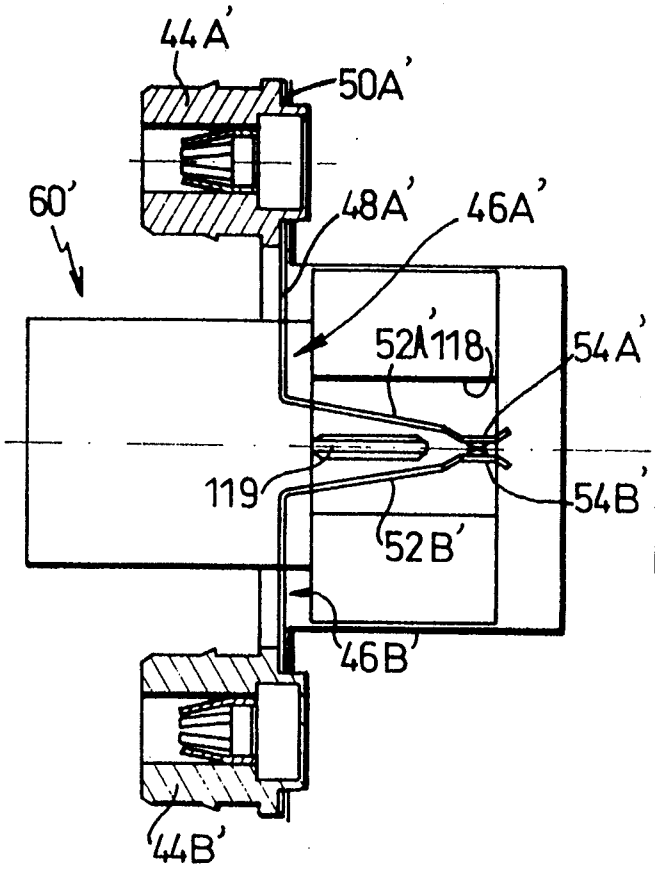
Figure 19:
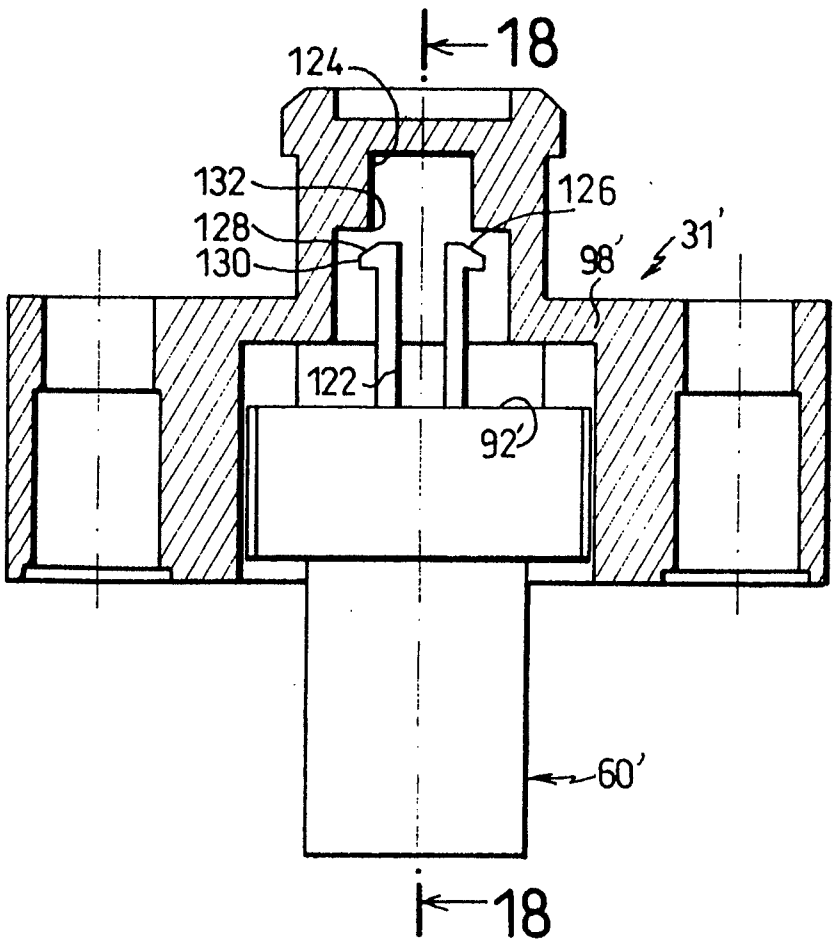
FIG. 19 is an axial cross-sectional view along line 19—19 of FIG. 18.
Figure 18:
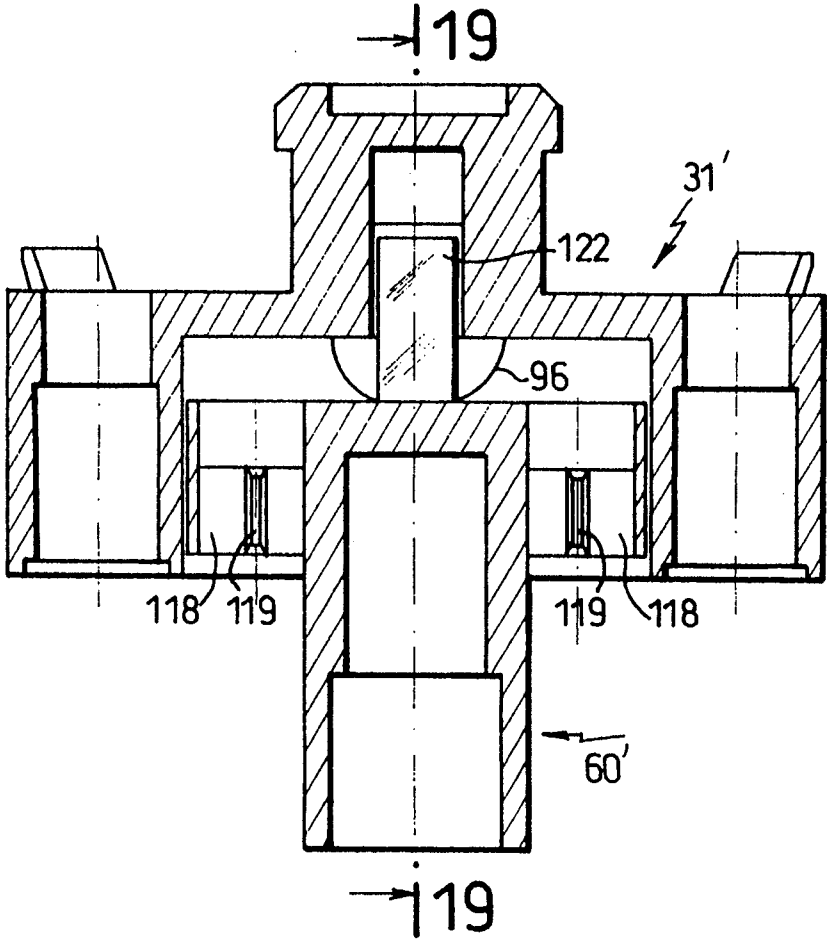
FIG. 18 is a cross-sectional view along line 18—18 of FIG. 19 illustrating the interaction of the second embodiment of the actuator with the second part of the insulating block of the first connector.

FIG. 9 illustrates the switch 101 which includes first and second switch contacts 46A, 46B. The switch contacts are in the form of blades or leafs. The first contact 46A is biased in the forward direction F against the rear of the second contact. However, the first contact 46A can be readily deflected in the rearward direction R, to break engagement with the second contact. The actuator 60 has a ridge or deflector 72 that deflects a free end branch or portion 52A of the first contact when the actuator moves to the rear. The first or actuator-biasing spring 100 urges the actuator 60 rearwardly.

Figure 2:
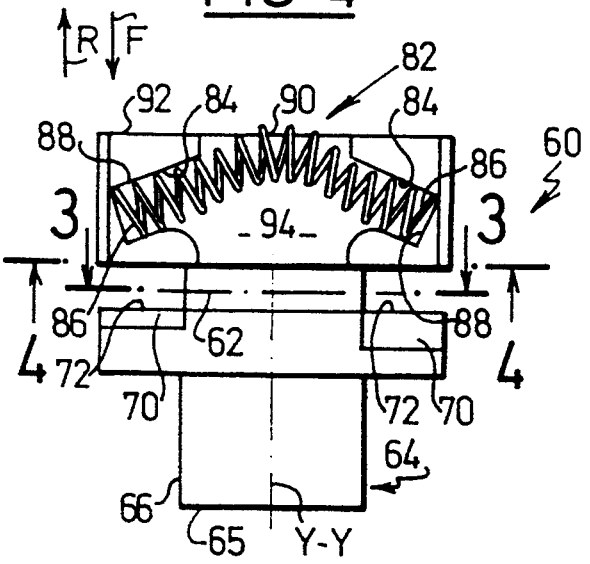
FIG. 2 is a side elevation view of the actuator of the connection assembly of FIG. 1.

A pair of trigger springs 82 (including spring or spring device 82X shown in FIG. 4) resist rearward movement of the actuator 60. As shown in FIG. 2, each trigger spring 82 has opposite ends 86 mounted on the body 62 of the actuator 60. The median portion or middle 90 of the spring is rearwardly bowed in the initial stable state of the spring, shown in FIG. 2. As the middle 90 is deflected forwardly (in direction F) it continues to resist such deflection until the middle reaches an intermediate position, when the spring lies in an unstable state. When the spring middle 90 reaches the intermediate position, its resistance to further forward deflection rapidly drops, and the middle can rapidly move further forward into a recess 94 in the actuator.

When one of the two trigger springs 82 reaches the intermediate position, where it can be further deflected by a suddenly-reduced force, the actuator 60 rapidly accelerates rearward. As soon as the actuator starts moving rapidly rearward, the other trigger spring immediately reaches its intermediate position and offers a greatly reduced resistance to further forward deflection. This assures that the balanced restraining forces applied to opposite sides of the actuator,both suddenly drop at substantially the same time to avoid cocking the actuator.

As the two connectors start mating, the pusher 114 (FIG. 9) on the second connector presses on the piston or spring compressing member 108 to start compressing the actuator biasing spring 100. Initially, the spring 100 is under little compression, so the middle of the trigger spring 82 is under little deflecting force. Only as the two connectors mate, do the actuator biasing spring 100 and trigger spring 82 become highly deflected. The actuator biasing spring thus serves to gradually deflect the trigger spring to bring it closer to the unstable release state as the two connectors gradually mate, and to thereafter supply the force to rapidly accelerate the actuator to rapidly open the switch when a predetermined degree of connector mating has been reached.

2. Detailed Description of The Embodiments

Figure 8:
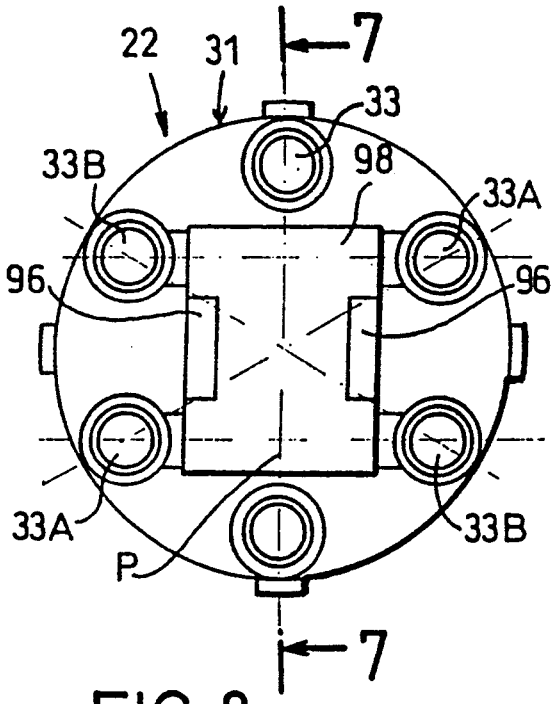
FIG. 8 is a left-hand view of the part of the insulating block illustrated in FIG. 7.

FIG. 8 shows that the rear housing part 31 of the first connector has six cells 33, 33A, 33B. Only the contact elements in cells 33A and 33B are electrically coupled through switches. The two switches lie on opposite sides of the actuator, and each switch connects a contact in one of the cells 33A to a contact in one of the cells 33B.

The second connector 24 (FIG. 1) comprises a housing 32, an insulating block 34 having two front and rear parts 35, 37, and six contact elements 36 complementary to the elements 30 of the first connector. The axial coupling of the two connectors 22 and 24 is facilitated by a coupling ring 38. Rotation of coupling ring 38 causes threads on it to move along threads on the outside of the first connector housing, to cause axial sliding of the two housings 26 and 32 along the direction X—X.

The two pairs of electrical contact elements 30 of the first connector 22 which are not connected together through a switch, are arranged on either side of the plane P (FIG. 8) that passes through the axis X—X and that extends perpendicular to the sectional plane of FIG. 1. Each of these two pairs includes two contact elements 30A and 30B (FIG. 9) accommodated in cells 33A and 33B (FIG. 8). In the uncoupled state (when the two connectors are unmated), the two contact elements 30A, 30B (FIG. 9) are electrically coupled together by the connecting device or switch 101, opening or closing of which has to be rapid.

The contact element 30A comprises a cylindrical rear portion 44A which is crimped into a hole formed in the contact leaf or blade 46A. The inner portion 48A of the blade in which the hole 50A is formed extends in a plane perpendicular to the axis of the connector and to the plane of FIG. 1. The blade 44A is prolonged by the coplanar end branch 52A whose free end 54A interacts with the free end 54B of the end branch 52B of the contact leaf or blade 46B. Contact blade 46B is associated with the contact element 30B whose rear cylindrical portion 44B is crimped in a hole 50B of blade portion 48B.

When the connectors are unmated, the two blade free ends 54A and 54B are in electrical contact with each other. The free ends are pressed together due to a slight bending of the blades 46A and 46B.

The rear portions 44A, 44B of the contacts are in the form of independent conductive bushings that are mounted between the two parts 29 and 31 (FIG. 1) of the insulating block 28. The bodies of the contact elements 30A and 30B (FIG. 9) are inserted into the bushings 44A, 44B, and the bodies of the contact elements are held by resiliently deformable fingers 40 (FIG. 1) of slotted ferrules 41.

As described above, the first connector has two identical switches such as 101 (FIG. 9). Each switch has leafs or blades 46A, 46B with associated ends 54A and 54B whose movements (especially of end 54A) are controlled by an actuating member or actuator 60.

Referring to FIG. 2, it is seen that the body 62 of the actuator 60 comprises a hollow cylindrical front end part 64 whose outer cylindrical surface 66 is mounted so as to slide in a corresponding bore 68 (FIG. 1) of the insulating block 29 of the first connector 22.

Figure 5:
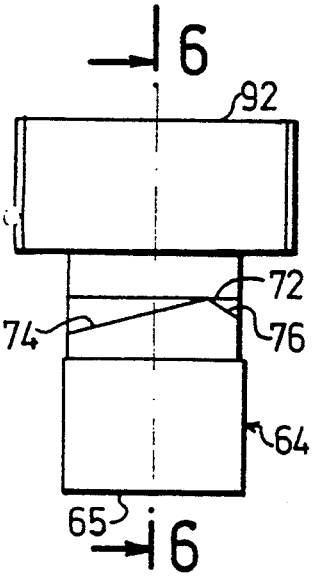
FIG. 5 is a left-hand side view of the actuator illustrated in FIG. 2.
Figure 3:
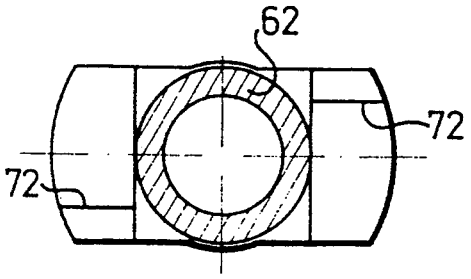

The actuator has actuating fingers 70 (FIG. 2) on either side of its general axis Y—Y which is coincident with the connector axis X—X. Each actuating finger 70 includes a deflector or deflector device in the form of a ridge 72 (FIG. 5) having two sloping sides 74, 76. The ridge 72 contacts the blade branch 52A (FIG. 9) or the contact blade 46A to move it away from the other blade 46B to separate the ends 54A and 54B and thus open the switch.

The actuator has a rear end portion 80 (FIG. 4) in which two identical helical trigger springs 82, 82X are arranged symmetrically on either side of the axis Y—Y. Each spring such as 82 (FIG. 2) is mounted slightly compressed in the actuator body or housing, with two opposite housing parts 84 being slightly inclined in order to form an obtuse angle between them. The trigger spring opposite ends 86 bear against the bottoms 88 of the two housing parts 84 which accommodate the spring 82.

Figure 7:
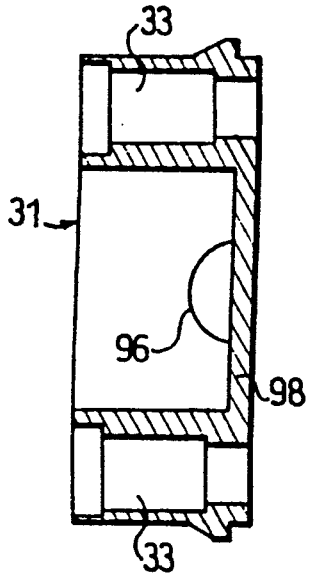
FIG. 7 is an axial sectional view, taken along line 7—7 of FIG. 8, of the rear part of the insulating block of the first connector.

The middle or median portion 90 of each spring 82 is, in its stable position illustrated in FIGS. 2, inwardly, or rearwardly (R), bowed or curved towards and slightly beyond the rear face 92 of the actuator 60. The middle of the trigger spring can be deformed into a recess 94. The trigger spring middle rapidly retracts into the recess 94 when pushed forwardly far enough by the trigger surface 96 (FIG. 7). As shown in FIG. 8, two triggers or trigger surfaces 96 are formed at opposite sides of a rear transverse wall 98 of the insulating block 31. Each triggering surface 96 has, for example, a semi-cylindrical profile.

The two trigger springs 82 (FIG. 2) which are arranged in parallel and whose design is identical, constitute a monostable spring which presses the actuator 60 forwardly towards its rest position, when the first connector is in the unmated or uncoupled position (see the upper part of FIG. 1). The front circular edge 65 (FIG. 2) of the actuator cylindrical portion 64 then bears axially against a radial shoulder 67 (FIG. 1) in the bore 66 of the insulating block 29. In this rest position, the convex middle portions 90 (FIG. 2) of the springs 82 bear against the convex projecting trigger surfaces 96.

Figure 4:
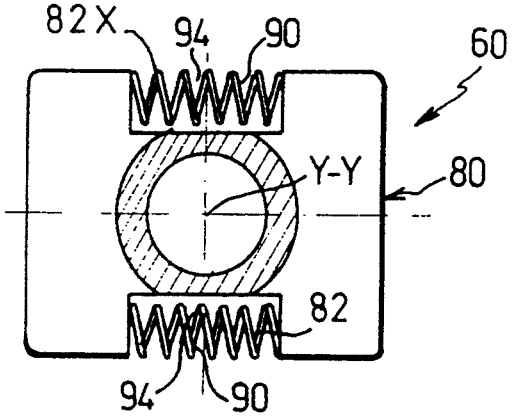
FIGS. 3 and 4 are cross-sectional views along lines 3—3 and 4—4 of FIG. 2.

In the non-retraced trigger spring position illustrated in FIGS. 2 and 4, the springs 82 exert a force on the actuator whose value, called retraction value, determines the force for triggering the switches to cause their simultaneous opening.

When, under the action of the trigger surfaces 96, the median portions 90 of the trigger springs are forwardly deflected and then rapidly retract inside the recesses 94, the springs 82 then apply only a slight forward force to the actuator 60. This slight forward force has a value, called the residual value, which determines the value for triggering the closing of the switches (which have been previously opened).

The triggering device includes the helical actuator-biasing spring 100 (FIG. 9) which biases the actuator rearwardly. The spring 100 is a conventional helical compression spring mounted coaxially with the actuator 60 which it permanently presses rearwardly towards its rearward or active position (illustrated in the lower part of FIG. 1), that is to say towards the right when considering FIG. 1.

Figure 6:
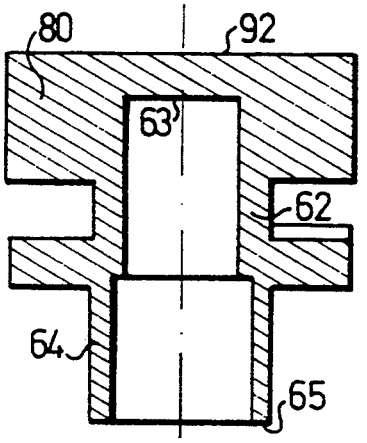
FIG. 6 is a cross-sectional view along line 6—6 of FIG. 5.

The first or rear axial end 102 of the spring 100 lies within the front part 64 of the actuator 60 and bears against the transverse bottom 63 (FIG. 6) of the actuator. The second or forward axial end 104 (FIG. 1) of the spring 100 bears against the bottom 106 of a hollow piston 108 mounted so that it slides axially in the front insulating block 29. The front end face 110 of the piston 108 faces the pusher 114 of the second connector (and the front coupling face 112 of the insulating block of the second connector). The action of the cylindrical control pusher 114 on the piston 108, and thus on the helical spring 100, has the function of varying the value of the force applied by the spring 100 to the actuator 60. The minimal value of this force, in the uncoupled state, is chosen to be lower than the residual value of the second counteracting spring constituted by the pair of trigger springs 82. The maximum value of the force applied to the actuator by the helical spring 100, in the final coupled state of the two connectors, is chosen to be greater than the rapid retraction value of the second counteracting spring (the two trigger springs). The force applied by the spring 100 varies between these two extreme values, substantially linearly as a function of the relative axial coupling or uncoupling travel of the two connectors.

The connection assembly 20 operates in the following manner.

Starting from the uncoupled position illustrated in the upper part of FIG. 1, the user proceeds to couple the two connectors 22 and 24. During this coupling, the value of the force applied by the first spring 100 progressively increases. By way of the actuator 60, the first spring force causes forward deflection of the median portions 90 of the trigger springs 82 bearing against the triggering surfaces 96.

The increase in force continues, without giving rise to noticeable movement of the actuator, until the value of the force due to the spring 100 becomes greater than the rapid retraction value of the springs 82 (82 and 82X). As soon as this value is reached, the springs 82 rapidly retract and the actuator 60 moves rearwardly at great speed with respect to the insulating blocks 29 and 31, towards the right when considering FIG. 1. This causes substantially simultaneous opening of the two switches. The actuator 60 and the two connectors then occupy the relative positions illustrated in the lower part of FIG. 1.

This actuation of the switches to open them is hence independent of the coupling speed of the two connectors 20 and 22. The opening of the switches occurs even if the user interrupts his coupling action, or even if he reverses the direction of the relative axial displacement of the two connectors, for example with a view to uncoupling them.

The calibration and the elastic constant of the first spring 100 are determined so that the first spring applies a force to the actuator that is greater than the rapid retraction value when the electrical contact elements 30A and 30B are already electrically connected to the corresponding contact elements of the second connector 24, this so as not to break the circuits.

During uncoupling, the initial force applied to the actuator 60 by the spring 100 is distinctly greater than the residual value of the force which the two retracted springs 82 are applying to the actuator. The force applied by the first spring is progressively reduced until it becomes less than this residual value.

As soon as the first spring presses on the actuator with less than the residual valve, the springs 82 rapidly regain their stable position and the force that they apply to the actuator then rapidly reaches its retraction value. The retraction value is greater than the force applied at this instant by the first spring 100. This makes it possible for the force applied by the trigger springs to rapidly compress the spring 100, even if the user interrupts the uncoupling operation.

Under the action of the trigger springs 82 suddenly bowing rearwardly again, the actuator 60 moves at great speed towards its rest (forward) position, while causing simultaneous closing of the switches. The rapid openings of the triggering switches is thus also independent of the speed of uncoupling of the two connectors 22 and 24.

Figure 20:
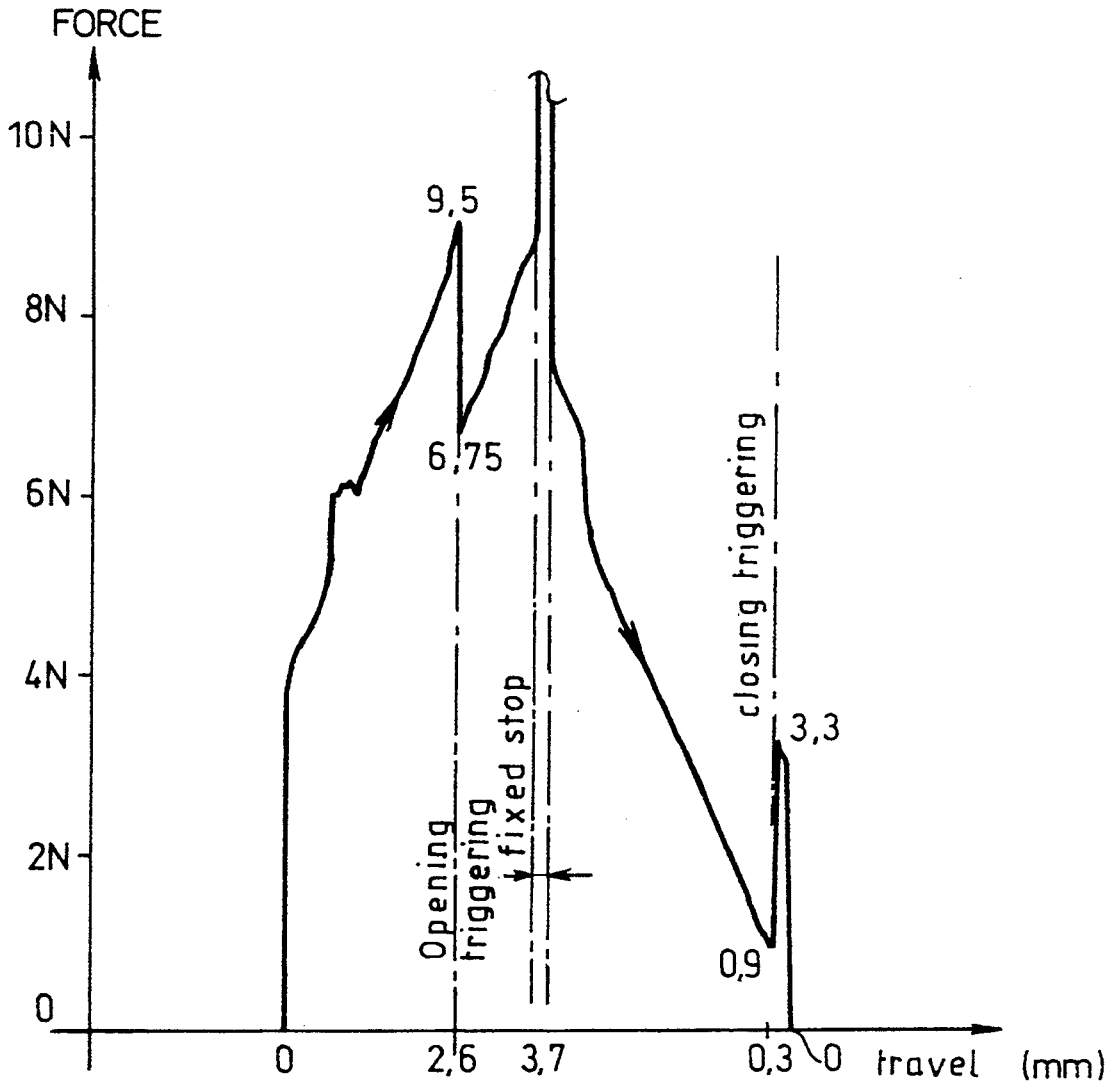
FIG. 20 is a force-travel diagram illustrating the operation of the triggering device according to the invention.

As may be noted in FIG. 20, whose curve illustrates the value of the force measured by determining the force exerted on the end of the piston 108 as a function of its axial travel, the triggering of the opening of the switches occurs after a piston travel of 2.6 mm. During the "return" or forward travel of the piston 108, triggering of the closing of the switches occurs at 0.3 mm with respect to the start origin (most rearward piston position).

The above shows that a hysteresis phenomenon exists, equal to $2.6-0.3=2.3$ mm, between the position of the piston corresponding to the triggering of the opening of the switches and the position of the piston corresponding to the triggering of the closing of the switches. This phenomenon guarantees the absolute absence of a risk of fluttering in the "opening-closing" system of the switches, in the event that the user advances the locking ring of the plug 24 onto the base 22 slowly and hesitantly, for example by stopping the rotation of the ring after triggering the opening and by coming slightly back, then slightly forward, etc.

On the other hand, the curve reveals the speed and the rapidity of the opening corresponding to a drop in the force equal to 2.3 N (Newtons) and of the closing corresponding to a rise equal to 2.2 N.

The speeds of displacement of the actuator during switch opening and closing are completely independent of the relative speed of displacement of the pusher 114 with respect to the housing of the connector 22 and thus of the rotation speed of the locking ring.

The fundamental characteristic of the triggering device which has just been mentioned provides opening and closing times for the switches which are very short and independent of the dexterity of the user. The device also suppresses any risk of remaining "hung", that is to say that one of the two switches is already open while the second remains closed.

The second embodiment illustrated in FIGS. 10 to 19 will now be described.

In this variant, the end branches 52A' and 52B' (FIG. 15) of the contact blades 46A' and 46B' each extend along a direction substantially parallel to the axis of the connector. Each blade is curved with respect to the fixing portion 48A', 48B' of the respective blade In the closed position of the switches, the free ends 54A' and 54B' are in contact at least one point situated substantially on the axis of the connector.

In order to limit the axial size, the end branches 52A' and 52B' extend into an orifice 118 formed in the body of the actuator 60'. The center of the orifice is divided by a partition or wedge 119 which constitutes the actuating finger of the switch. In the open position, the finger 119, made of insulating material, extends between the blade free ends 54A' and 54B'.

Applicant improves operation of the switches, especially by increasing the hysteresis phenomenon, by providing a rearwardly projecting clamp 120 (FIG. 14) on the actuator 60'. The clamp, which rearwardly prolongs the actuator, includes two jaws 122 (FIG. 19) which interact with the walls of a corresponding blind hole 124 formed in the rear wall 98' of the insulating block 31'. The free ends 126 of the jaws 122 are chamfered at 128 and comprise lateral surfaces 130 which are substantially parallel to the axis.

During coupling, the chamfers 128 first come to bear against the edge of the open end 132 of the blind hole 124. An additional force is necessary to resiliently deflect the jaws 122 together to enter the hole. This additional force is added to the value known as the retraction value of the trigger springs 82, 82X. As the trigger springs reach the intermediate position and the actuator rapidly moves back, the front wall 92' of the actuator hits the front wall 98' of the housing rear part 31'. This results in an audible click perceptible to the user which unequivocally informs him of the changeover of the switches. During uncoupling, a click of lower intensity, is produced as the jaws 122 spring apart behind the location 132.

During uncoupling, the hollow piston 108 (FIG. 1) moves towards the front of the connector 22 at the same speed as the pusher 114. To assure this, it is possible to provide for the free end 115 of the pusher 114 to lie in a groove in the piston 108.

It is possible, without departing from the scope of the invention, to reverse the notions of opening and closing of the switches with respect to the rest and active positions of the actuator. Similarly, it is possible to provide for the triggering device to be integrated into the plug connector rather than the socket connector.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A first electrical connector which is designed to mate with a second electrical connector, comprising:

a switch mounted on said first connector, said switch including first and second contacts wherein said first contact can be deflected away from said second contact to open said switch;

an actuator which has a deflector, said actuator being movable in a rearward direction to move said deflector against said first contact to open said switch;

a trigger spring which is coupled to said actuator to be deflected by movement of said actuator, said trigger spring having a stable state wherein it biases said actuator in a forward direction, said trigger spring being mounted to suddenly decrease its biasing force in said forward direction when deflected to a predetermined intermediate position;

an actuator biasing device which includes an actuator biasing spring that has a first spring portion positioned to be progressively deflected as said connectors mate, and which has a second portion coupled to said actuator to bias it in said rearward direction with a force that increases progressively as said first spring portion is progressively deflected, to move said actuator progressively rearwardly and thereby progressively deflect said trigger spring, until said trigger spring reaches said intermediate position, when the forward biasing force of said trigger spring suddenly decreases to thereby allow rapid rearward acceleration of said actuator under the force of said biasing spring.

2. The connector described in claim 1 wherein:

said first connector is constructed to move in said forward direction to mate with said second connector;

said actuator biasing spring comprises a coil spring extending in forward and rearward directions and having forward and rearward ends, with said coil spring rearward end pressing said actuator in said rearward direction;

said actuator biasing device includes a piston that is separately slidably mounted in said first connector and which is coupled to said forward end of said actuator biasing spring, said piston having a front end which is exposed when said connectors are not mated so as to be pushed rearwardly by the mating second connector.

3. The connector described in claim 1 wherein:

said actuator has opposite sides, and including a second trigger spring device which is substantially identical to said trigger spring with each comprising a coil spring having opposite ends mounted on said actuator, said trigger spring and second trigger spring device lying on opposite sides of said actuator;

said trigger spring and trigger spring device each comprises a coil spring that has opposite ends each mounted on said actuator, and a middle which is bowed in said first direction in said stable state, said actuator having a recess that receives said middle in said second state;

said trigger spring and trigger spring device being positioned so both reach said intermediate position at substantially the same position of said actuator.

4. The connector described in claim 1 including:

a second switch device that is substantially identical to said switch, said actuator has a deflector and deflector device on said opposite sides, and said switch and switch device lie on opposite sides of said actuator and are positioned to be opened simultaneously, respectively by said deflector and deflector device.

5. The connector described in claim 1 wherein:

said first contact comprises an elongated leaf which has a free end which is biased in a forward direction toward said second contact, but which can be deflected rearwardly away from it.

6. The connector described in claim 1 wherein:

at least said first contact has a free end portion extending primarily in said rearward direction and being deflectable primarily perpendicular to said rearward direction away from said second contact, with said first contact free end extending at an incline to said rearward direction toward said second, contact;

said deflector comprises a wedge that moves against said inclined first connector free end to deflect it away from said second contact as said actuator moves rearwardly.

7. Switching apparatus comprising:

a housing having forward and rearward portions;

an actuator which is slidable in forward and rearward directions in said housing, said actuator having a deflector;

a switch mounted on said housing and including first and second contacts, with said first contact having an end biased against said second contact and being positioned to be deflected away from said second contact by said actuator deflector when said actuator moves in said rearward direction;

a trigger coil spring having opposite ends mounted on said actuator and a middle which is rearwardly bowed in an initial stable position of said trigger spring, said trigger spring middle resisting forward deflection with a force that suddenly decreases when said trigger spring middle is rearwardly deflected to an intermediate position;

a trigger mounted on said housing behind said trigger spring middle;

an actuator-biasing coil spring having a rear end coupled to said actuator to urge it rearwardly, and having a front end;

a spring compressing member mounted to said front end of said actuator biasing spring for pressing said front end progressively rearwardly, to cause said actuator to progressively advance rearwardly and cause said trigger spring middle to be deflected forwardly until said middle reaches said intermediate position, and to cause said actuator-biasing spring to store spring energy to thrust said actuator rearwardly when said trigger spring middle reaches said intermediate position.

8. The switching apparatus described in claim 7 including:

first and second mateable connectors, said first connector including said housing;

said second connector having a pusher which pushes said spring compressing member rearwardly as said connectors mate.

9. Electrical connection assembly (20) of the type comprising a first (22) and a second (24) complementary connector each comprising a housing (26, 32) in which is arranged an insulating block (28, 34) which accommodates electrical contact elements (30, 30A, 30B, 36), wherein said connectors are constructed to be coupled by relative axial displacement of the two housings along an axis (X—X), and wherein said first connector includes a switch having two electrical contact elements (30A, 30B) which are, in the uncoupled position, electrically coupled together and wherein opening of the switch is brought about during the operation of coupling the two connectors, characterized in that:

said switch contacts comprise contact blades (46A, 46B) having free ends (54A, 54B) which are in mutual contact in the uncoupled position, an actuating member (60) mounted so that it slides axially in the housing of the first connector (22) between a rest position in which the switch is closed and an active position in which an actuating finger (72, 119) of the actuating member (60) brings about the opening of the switch by breaking the contact between said free ends (54A, 54B) of the contact blades, the actuating member (60) being subjected, on the one hand, to the action of a first spring (100) which biases said actuator towards its active position and which is pushed by a pusher member (114) coupled to the housing of the second connector (24) to cause the value of the force applied through said first spring (100) to the actuating member (60) to vary as a function of the relative axial displacement of the two housings (26, 32) during the operations of coupling and of uncoupling, between a minimum value lower than a value for triggering the closing of the switch and a maximum value greater than a value for triggering the opening of the switch, and, on the other hand, to the action of a second, trigger spring (82) of the monostable rapid-retraction type which biases the actuating member (60) towards its rest position and whose retraction value determines the said value for triggering the opening of the switch and whose residual value in the retracted position determines the said value for triggering the closing of the switch.

10. Connection assembly according to claim 9, characterized in that the first spring (100) is of the helical compression type, a first end (102) of which bears against a face (63) of the actuating member (60) and the other end of which (104) is subjected to the action of said pusher member (114).

11. Connection assembly according to claim 10, characterized in that the actuating member (60) comprises a hollow cylindrical end portion (64) inside which extends the first end (102) of the helical spring (100) and whose outer cylindrical surface (66) is mounted so that it slides axially in a corresponding bore (68) of the insulating block (29) of the first connector (22).

12. Connection assembly according to claim 9, characterized in that the trigger spring is a curved helical spring (82) carried by the actuating member (60), the trigger spring having ends (86) which bear against corresponding bearing faces (88) of the actuating member and which, in the normal, stable position, has its convex median portion (90) turned towards a triggering surface (96) of the first connector (82), this median portion being capable of retracting into a recess (94) formed in the actuating member (60).

13. Connection assembly according to claim 12, characterized in that the second spring is produced in the form of a pair of identical springs (82) arranged symmetrically on either side of a plane passing through the axis (Y—Y) of the actuating member.

14. Connection assembly according to claim 9, characterized in that the two contact blades (46A, 46B) each comprise an end branch (52A, 52B) which extends along a direction which is substantially perpendicular to the axis (X—X), in that the free ends of the branches (54A, 54B) are arranged axially one behind the other, and in that the actuating finger interacts with one (52A) of the branches in order to distance it axially from the other (52B) so as to bring about opening of the switch.

15. Connection assembly according to claims 9, characterized in that the two contact blades each comprise an end branch which extends along a direction substantially parallel to the axis, the actuating finger being, in the open position of the switch, accommodated between the free ends of the end branches.

16. Connection assembly according to claims 14 or 15, characterized in that, in the closed position of the switch, the free ends (54, 54B) of the contact blades are elastically biased toward each other.

17. Connection assembly according to claim 9, characterized in that said first connector includes two pairs of electrical contact elements (30A, 30B) arranged symmetrically on either side of a plane containing the axis (X—X) of the first connector (22), the two contact elements of each pair being electrically coupled together;

said actuating member (60) comprises two drive fingers (72, 119) arranged symmetrically so each deflects a first contact of a different one of said pairs when said actuator moves toward its active position.

18. Connection assembly according to claim 9, characterized in that the actuator comprises a member (120, 122) which interacts with a corresponding portion (124) of the insulating block (31) of the first connector (22) in order to augment the value of the force for triggering the opening of the switch.

* * * * *